United States Patent [19]

Drobka

[11] 4,180,017

[45] Dec. 25, 1979

[54] PIPE ASSEMBLY-HEAT EXCHANGER-STEAM DRUM UNIT

[75] Inventor: Witold Drobka, Berlin, Fed. Rep. of Germany

[73] Assignee: Borsig GmbH, Berlin, Fed. Rep. of Germany

[21] Appl. No.: 926,333

[22] Filed: Jul. 20, 1978

[30] Foreign Application Priority Data

Aug. 1, 1977 [DE] Fed. Rep. of Germany ..... 2735064

[51] Int. Cl.[2] ..... F22B 1/06; F22B 37/26

[52] U.S. Cl. ..... 122/34; 122/32; 122/491

[58] Field of Search ..... 122/32, 34, 488, 491

[56] References Cited

U.S. PATENT DOCUMENTS

| | | | |
|---|---|---|---|
| 3,147,743 | 9/1964 | Romanos | 122/32 |
| 3,262,428 | 7/1966 | Romanos | 122/34 |
| 3,653,363 | 4/1972 | Romanos | 122/34 |
| 3,700,030 | 10/1972 | Bosquain et al. | 122/32 |

*Primary Examiner*—Kenneth W. Sprague
*Attorney, Agent, or Firm*—Becker & Becker, Inc.

[57] ABSTRACT

A pipe assembly-heat exchanger-steam drum unit, which comprises a pipe assembly heat exchanger for a heat exchange between media of relatively high pressure differentials and a steam drum with a liquid chamber and a steam chamber while the medium passing through the pipes of the pipe assembly-heat exchanger has a high entering temperature, and a pipe bottom located on the inflow side of the hot medium is thin. In the pipe assembly heat exchanger there is furthermore provided a device for relieving the thin pipe bottom. In the pipe assembly-heat exchanger there is also provided a device which is so designed that the cold medium entering the pipe assembly-heat exchanger is conveyed to the thin pipe bottom. The pipes of the pipe assembly-heat exchanger are as an assembly of pipes transversely and centrally passed through the steam drum while the pipe assembly-heat exchanger and the steam drum form a unit with each other. The pipes are at the inflow side of the hot medium by means of the thin pipe bottom connected to the mantle of the pipe assembly-heat exchanger while the pipes in the discharge side of the medium passing through the pipes are through a thin pipe bottom connected to the upper side of the mantle of the steam drum.

9 Claims, 3 Drawing Figures

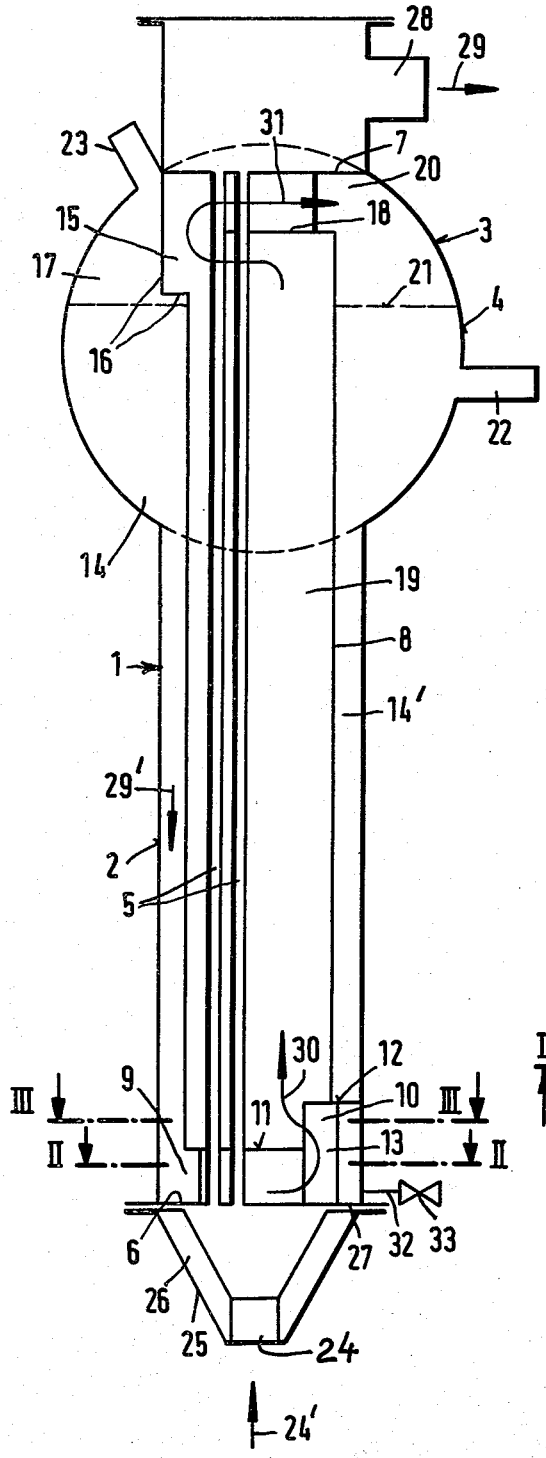
Fig.1
Fig.3
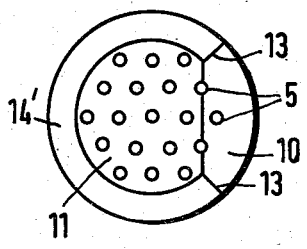
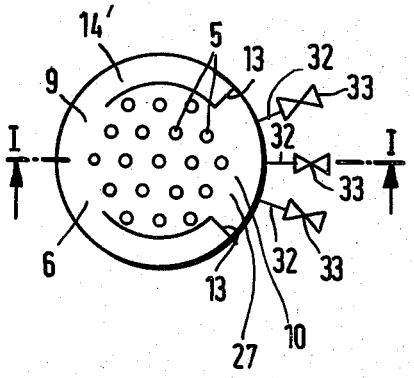
Fig.2

PIPE ASSEMBLY-HEAT EXCHANGER-STEAM DRUM UNIT

The present invention relates to a pipe assembly-heat exchanger-steam cylinder unit comprising a pipe assembly or nest of boiler tubes-heat exchanger for the heat exchange between materials of great difference in pressure and a steam cylinder with a liquid chamber and a steam chamber, while the material passing through the pipes of the pipe assembly-heat exchanger has a high input temperature, and the pipe bottom located on the inflow side of the hot material is relatively thin and there is provided a device for relieving the thin pipe bottom, and while furthermore a device is provided in the pipe assembly-heat exchanger which is designed in such a way that the colder material entering the pipe-assembly-heat exchanger is passed to the relatively thin pipe bottom.

With pipe assembly-heat exchanger-steam cylinder units of the just mentioned type it is necessary, in order to obtain a fast cooling off of the hot material, to make the pipe bottom at the inflow side of the hot material relatively thin and to protect the thin pipe bottom against bulging, due to the high pressure of the colder material in the mantle of the pipe assembly-heat exchanger, by an appropriate device, and furthermore to pass the entering colder material uniformly distributed to the thin pipe bottom, and to effect the passage of the colder material and its withdrawal from the heat exchanger into the steam cylinder.

It is known for meeting these requirements to design the pipe bottom of the pipe assembly-heat exchanger at the inflow side of the hot material relatively thin and to design the pipe bottom on the cold ends of the pipes with a normal thickness, while the relieving device for the thin pipe bottom in the area passed through by the colder material is arranged in spaced relationship to the thin pipe bottom and is anchored thereto. It is furthermore known to provide the relieving device with guiding means for a uniformly distributed passage of the colder material to the relatively thin pipe bottom. Such an arrangement is disclosed, for instance, in German Pat. No. 1294981. Furthermore a separate steam cylinder is provided with gravity tubes and stand pipes or risers. The installation of the relieving device for the thin pipe bottom with the guiding means for the colder material requires considerable shop equipment, while the assembly of the separate steam cylinder with the gravity tubes and the risers on the building site is rather expensive.

It is, therefore, an object of the present invention to provide an improved pipe assembly-heat exchanger-steam cylinder unit which will overcome the above mentioned drawbacks.

It is a further object of the present invention to provide a heat exchanger of the above mentioned general type in which the pipe assembly-heat exchanger with the steam cylinder is so arranged that the relieving device, heretofore necessary in connection with thin pipe bottoms, will become superfluous, and in which the pipe assembly-heat exchanger-steam cylinder unit in the workshop and on the building site will need only simple techniqual means and less expenses.

These and other objects and advantages of the invention will appear more clearly from the following specification in connection with the accompanying drawing, in which:

FIG. 1 diagrammatically illustrates a longitudinal section taken along the line I—I of FIG. 2 and illustrates a vertically arranged pipe assembly-heat exchanger-steam cylinder unit according to the invention in which water is used as the colder material of high pressure. For the sake of simplicity only two pipes of the heat exchanger are shown.

FIG. 2 shows a cross section taken along the line II—II of FIG. 1, but with more heat exchanger pipes shown than in FIG. 1.

FIG. 3 is a cross section taken along the line III—III of FIG. 1, but with more heat exchanger pipes shown than in FIG. 1.

The heat exchanger unit according to the present invention is characterized primarily in that the pipes of the pipe assembly-heat exchanger are designed as pipe assembly and are transversely and centrally passed through the steam cylinder, while the pipe assembly-heat exchanger and the steam cylinder form a unit, and while the pipes are by means of the thin pipe bottom at the inflow side of the hot material connected to the mantle of the heat exchanger, and, on the outflow side of the material passing through the pipes, are by means of the thin pipe bottom connected to the top side of the mantle of the steam cylinder.

In order to be able to provide in a simple manner a simple installation with one or more pipe assembly-heat exchangers, according to a further development of the present invention, one or more pipe assembly-heat exchangers form a unit with a single steam cylinder.

If under certain pressure and temperature conditions in the heat exchanger unit there exists the possibility that major bulging of the two thin pipe bottoms toward the outside may occur, it is suggested according to the present invention that the pipes are assembled under a tension pre-load.

To be able thoroughly to cool the pipes over their entire length and the relatively thin pipe bottom at the inflow side of the hot material, the pipes are, in conformity with the present invention, surrounded by a cylindrical inner mantle. This inner mantle is toward the pipe bottom on the inflow side for the hot material provided with two recesses for a connection between the water chamber outside the inner mantle and the steam water chamber inside the inner mantle. Furthermore, the cylindrical mantle is toward the pipe bottom on the cold side of the pipes provided with a recess for a connection between the steam water chamber and the steam chamber. A flow passage is formed for the cold water coming from the water chamber into the steam water chamber, namely by the first recess in the direction of flow of the cold water, by a guiding plate extending parallel to the pipe bottom and having a circular shape, by the second recess located opposite the first recess, furthermore by two axially extending separating plates, and by a separating plate inserted parallel to the guiding plate, all three separating plates being located between the inner mantle and the mantle of the pipe assembly-heat exchanger. Furthermore, there is provided a flow passage for the discharge of the steam-water mixture from the steam water chamber into the steam chamber of the steam cylinder. This flow passage is formed by a partly radially broadening (with regard to the inner mantle) with an enclosing of the inner mantle toward the pipe bottom on the cold side of the pipes, by a circular guiding plate arranged parallel to the pipe bottom, and by the recess in the inner mantle.

For preventing the formation of adhering or sticking deposits on the pipe bottom rim of the pipe bottom on the inflow side of the hot material into the water chamber of the pipe assembly-heat exchanger, and to be able to elutriate or wash-off any deposits, according to a further development of the invention, the inlet hood for the hot material of the pipe assembly-heat exchanger is equipped with an inner insulating layer which covers the pipe bottom rim of the pipe bottom in an insulating manner. Closely above the pipe bottom rim in the radial region of the second recess of the inner mantle there are, in the mantle of the pipe assembly-heat exchanger, provided one or more connecting pipe sections with shut-off valves.

Referring now to the drawings in detail, the pipe assembly-heat exchanger-steam cylinder unit according to the invention comprises the pipe assembly-heat exchanger 1 with a mantle 2 and the steam cylinder 3 with a mantle 4; said mantles 2 and 4 are fixedly connected to each other. The pipes 5 passed through by the hot material to be cooled are on the inlet side for the hot material connected to the thin pipe bottom 6 connected to the mantle 2 and on the out-flow side for the cooled material are connected to the thin pipe bottom 7 which is connected to the bottom side of the mantle 4. The pipes 5 arranged in a bundle are surrounded by a cylindrical inner mantle 8 which stands upright on the thin pipe bottom 6 and extends up to the pipe bottom 7. The inner mantle 8 is at the thin pipe bottom 6 provided with a recess 9. On the oppositely located side of the recess 9, the inner mantle 8 is at the thin pipe bottom 6 provided with another recess 10 which is twice as high as the recess 9. The circular guiding plate 11 which is parallel to the thin pipe bottom 6 and is inserted in the inner mantle 8 brings about a pronounced flow of the cold water along the thin pipe bottom 6. The annular sector shaped partition 12 and the two rectangular partitions 13 form a deflecting chamber deflecting the water oncoming through recess or perforation 9 in the direction of arrow 30 into the steam-water chamber 19. On one side of the upper end of the inner mantle 8 there is provided the partially radially broadened part 15 of the inner mantle 8 for the outlet of the rising steam-water mixture. This radially broadened part 15 is by means of the mantle 16 closed relative to the steam chamber 17 of the steam cylinder 3 so that the steam-water mixture will be able to flow between the pipe bottom 7 and the circular guide plate 18 arranged parallel to said pipe bottom 7 thereby obtaining a prounounced and defined flow at the pipe bottom 7 so that standing steam cushions will be avoided in this region. The outlet of the steam-water mixture from the steam-water chamber 19, the chamber within the inner mantle 8, into the steam chamber 17 is effected by the recess 20 of the inner mantle 8. The water level in the steam cylinder 3 is designated with the reference numeral 21. Water is pressed through the inlet pipe connection 22 into the steam cylinder 3, whereas the steam leaves the steam cylinder 3 through the outlet pipe section 23. The hot medium is through the opening 24 (arrow 24) introduced into the inlet hood 25 which is provided with the inner insulating layer 26 and in an insulating manner covers the pipe bottom rim 27 of the thin pipe bottom 6, passes through the pipes 5 and leaves the unit through the exit pipe connection 28 in the direction of the arrow 29. In the water chamber 14 the water flows in the direction of the arrow 29'toward the thin pipe bottom 6 and further in the direction of the arrow 30 through the flow passage on this pipe bottom into the steam-water chamber 19 and from there in the form of a steam-water mixture in the direction of the arrow 31 into the steam chamber 17. The elutriating connections in the mantle 2 are designated with the reference numeral 32 and the shut-off valves thereof are designated with the reference numeral 33.

As will be evident from the above, the advantages obtained by the present invention consist especially in that a relieving device for the thin pipe bottom 6 on the in-flow side of the hot medium, in the form of expensive insertions becomes superfluous. This is due to the fact that the relieving device according to the invention is obtained by the assembly of the pipe bundle-heat exchanger and the steam cylinder arranged transverse thereto, and more specifically is due to the fact that the thin pipe bottom 6 is connected to the mantle of the pipe assembly-heat exchanger, whereas the other thin pipe bottom is connected to the top side of the mantle of the steam cylinder. As a result thereof, with correspondingly dimensioning the pipes and the two mantles, and at a higher pressure of the colder medium around the pipes, the oppositely effected longitudinal expansion of the pipes and the shortening of the length of the pipe bundle-heat exchanger mantle are completely eliminated by the corresponding large transverse expansion of the heat cylinder mantle. Minor differences in length of for instance a few tenths of a millimeter which occur in view of temperature differences between the mantles and the pipes, are absorbed by the two thin bottoms which as is well known at the outer rim of the bottoms act as diaphragms. If major differences in length are possible due to the higher temperature differences, the pipes are installed under tension preload.

The thin pipe bottom on the out-flow side of the medium to be cooled is necessary according to the invention. The thin pipe bottom is considerably cheaper than a normal pipe bottom and with sometimes occurring high starting temperatures of the medium to be cooled cannot heat up to such a high temperature that the admissible strength values are exceeded.

The inner mantle around the pipes will take care of a cooling of the pipes over their entire length.

Due to the arrangement of the flow passages above the pipe bottom on the incoming side of the hot medium, a well defined transverse flow over said pipe bottom can be realized and the said transverse flow will wash possibly encountered solid materials from the heat affected portion of the pipe bottom toward the pipe bottom rim which latter is covered by the insulating layer of the inlet hood for the hot medium. At this location, solid material deposits cannot cause any damage and can easily be withdrawn through the elutriating pipe connection.

Due to designing one or more pipe assembly heat exchangers with a steam cylinder as a unit, space consuming parts for instance gravity pipes and risers as well as considerable assembly labor will be saved.

It is, of course, to be understood that the present invention is, by no means, limited to the specific showing in the drawings, but also comprises any modifications within the scope of the appended claims.

What is claimed is:

1. A pipe assembly heat exchanger-steam drum unit for a heat exchanger between media of relatively high differential pressure, which includes: a steam drum comprising a liquid receiving space with an inlet for liquid under pressure and also comprising a steam receiving space located above said liquid receiving space and provided with an outlet for releasing steam from said steam receiving space, a pipe-assembly-heat exchanger having inlet means and outlet means and having a first relatively thin bottom at one end and a second relatively thin bottom at its other end, said heat exchanger comprising pipes extending in the form of a nest of pipes transversely and substantially centrally through said steam drum and having one end located remote from said drum and connected to said first bottom while communicating with said inlet means for admitting a hot medium therethrough into said pipes, said pipes having another end connected to said second bottom while communicating with said outlet means for releasing said last mentioned medium after it has passed through said steam drum, said pipe assembly heat exchanger and said steam drum forming a unit with each other, and jacket means comprising a first mantle section surrounding said pipes from said steam drum to said first thin bottom and also comprising a second mantle section forming the outer wall of said steam drum and having a surface portion facing away from said inlet means.

2. A unit according to claim 1, which includes a heat exchanger comprising a plurality of nests of pipes and a single steam drum forming a unit therewith.

3. A unit according to claim 1, in which the pipes are under tension-preload.

4. A unit according to claim 1, which includes a cylindrical inner mantle surrounding said pipes and forming a steam-water chamber and together with said first mantle section defining an annular channel, said mantle resting on said first thin bottom and adjacent the latter being provided with said passage means establishing communication between said liquid receiving space outside said inner mantle and said steam-water chamber, said inner mantle also being provided with second passage means adjacent said second thin bottom for establishing communication between said steam-water chamber and said steam receiving space.

5. A unit according to claim 4, in which said first passage means include deflecting means for deflecting liquid received at said first thin bottom into said steam-water chamber.

6. A unit according to claim 5, in which said deflecting means include a circularly shaped guiding plate, two axially extending partitions, and an additonal partition parallel to said guiding plate.

7. A unit according to claim 4, in which said second passage means includes a bulged-out section adjacent said second thin bottom, a circularly shaped guiding plate, and a channel forming section.

8. A unit according to claim 1, in which said inlet means for admitting a hot medium includes a funnel-shaped hood with an inner heat insulating layer covering the rim area of said first thin bottom.

9. A unit according to claim 8, which includes at least one elutriating connection with shut-off valve, said connection being arranged slightly above said rim area in the lower region of said inner mantle and said outer mantle.

* * * * *